US012741179B2

(12) United States Patent
Baek et al.

(10) Patent No.: US 12,741,179 B2
(45) Date of Patent: Sep. 22, 2026

(54) MODE SWITCHING SYSTEM AND EXERCISE BIKE COMPRISING THE SAME

(71) Applicant: LG ELECTRONICS INC., Seoul (KR)

(72) Inventors: Changho Baek, Seoul (KR); Do Keun Hong, Seoul (KR); Juneyoung Song, Seoul (KR); Hyojun Son, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 146 days.

(21) Appl. No.: 18/707,304

(22) PCT Filed: May 18, 2023

(86) PCT No.: PCT/KR2023/006791

§ 371 (c)(1),
(2) Date: May 3, 2024

(87) PCT Pub. No.: WO2024/014688

PCT Pub. Date: Jan. 18, 2024

(65) Prior Publication Data

US 2025/0010137 A1 Jan. 9, 2025

(30) Foreign Application Priority Data

Jul. 11, 2022 (KR) ..... 10-2022-0085032

(51) Int. Cl.

| | |
|---|---|
| ***A63B 24/00*** | (2006.01) |
| ***A63B 21/00*** | (2006.01) |
| ***A63B 21/22*** | (2006.01) |
| ***A63B 22/06*** | (2006.01) |
| ***A63B 71/06*** | (2006.01) |

(52) U.S. Cl.
CPC ..... *A63B 24/0087* (2013.01); *A63B 21/225* (2013.01); *A63B 21/4034* (2015.10);
(Continued)

(58) Field of Classification Search
CPC ..... A63B 24/0087; A63B 21/225; A63B 21/4034; A63B 22/0605; A63B 71/0622;
(Continued)

(56) References Cited

U.S. PATENT DOCUMENTS 5,240,417 A 8/1993 Smithson et al.
11,724,151 B2 * 8/2023 Hansen ..... A63B 21/153 482/119

(Continued)

FOREIGN PATENT DOCUMENTS

AU 2021204037 A1 7/2021
CN 108100147 B 9/2021

(Continued)

*Primary Examiner* — Andrew M Kobylarz
(74) *Attorney, Agent, or Firm* — Birch, Stewart, Kolasch & Birch, LLP

(57) ABSTRACT

Disclosed herein are a mode switching system and an exercise bike comprising the same that switches a non-freewheel mode and a freewheel mode automatically, ensuring improvement in user convenience. The exercise bike comprise a step motor, a first limit sensor sensing a first part of the face gear and outputting a first sensing signal, a second limit sensor sensing a second part of the face gear and outputting a second sensing signal, and a controller determining a current power transfer mode by using the first sensing signal and the second sensing signal, and rotating the step motor forward or reversely, based on the current power transfer mode, to switch the power transfer mode to the non-freewheel mode or the freewheel mode, in a case where a mode switching signal is input.

20 Claims, 11 Drawing Sheets

(52) U.S. Cl.
CPC ..... *A63B 22/0605* (2013.01); *A63B 71/0622* (2013.01); *A63B 2024/0068* (2013.01); *A63B 2024/0093* (2013.01); *A63B 2220/833* (2013.01); *A63B 2220/89* (2013.01)

(58) Field of Classification Search
CPC .... A63B 2024/0068; A63B 2024/0093; A63B 2220/833; A63B 2220/89; A63B 2071/0081; A63B 2209/08; A63B 21/0051; A63B 21/0056; A63B 2220/24; A63B 2220/801; A63B 22/025; A63B 21/005; A63B 23/0476; A63B 71/0619; A63B 2022/0658; A63B 2225/50; A63B 2225/74
See application file for complete search history.

(56) References Cited

U.S. PATENT DOCUMENTS

| | | | | |
|---|---|---|---|---|
| 2005/0233866 | A1 | 10/2005 | Miyamaru et al. | |
| 2016/0023081 | A1* | 1/2016 | Popa-Simil | B62J 45/412 700/91 |
| 2019/0178313 | A1* | 6/2019 | Wrobel | F16D 41/04 |
| 2022/0074454 | A1 | 3/2022 | Wrobel | |
| 2022/0074455 | A1 | 3/2022 | Wrobel | |
| 2022/0111928 | A1 | 4/2022 | Donner | |
| 2022/0347515 | A1* | 11/2022 | Muhic | A63B 21/225 |
| 2023/0304548 | A1 | 9/2023 | Wrobel | |
| 2025/0082982 | A1* | 3/2025 | Xu | A63B 21/16 |
| 2025/0177801 | A1* | 6/2025 | Kim | A63B 24/0087 |

FOREIGN PATENT DOCUMENTS

| | | | | |
|---|---|---|---|---|
| CN | 113677589 | A | 11/2021 | |
| GB | 2 412 606 | A | 10/2005 | |
| KR | 10-2009-0090841 | A | 8/2009 | |
| KR | 10-2016-0069192 | A | 6/2016 | |
| KR | 10-2016-0074273 | A | 6/2016 | |
| KR | 10-1712711 | B1 | 3/2017 | |
| KR | 10-2022-0033118 | A | 3/2022 | |
| KR | 10-2022-0046235 | A | 4/2022 | |
| KR | 20220046235 | A * | 4/2022 | F16D 41/064 |
| WO | WO 2021/041736 | A1 | 3/2021 | |

* cited by examiner

[Fig. 1]
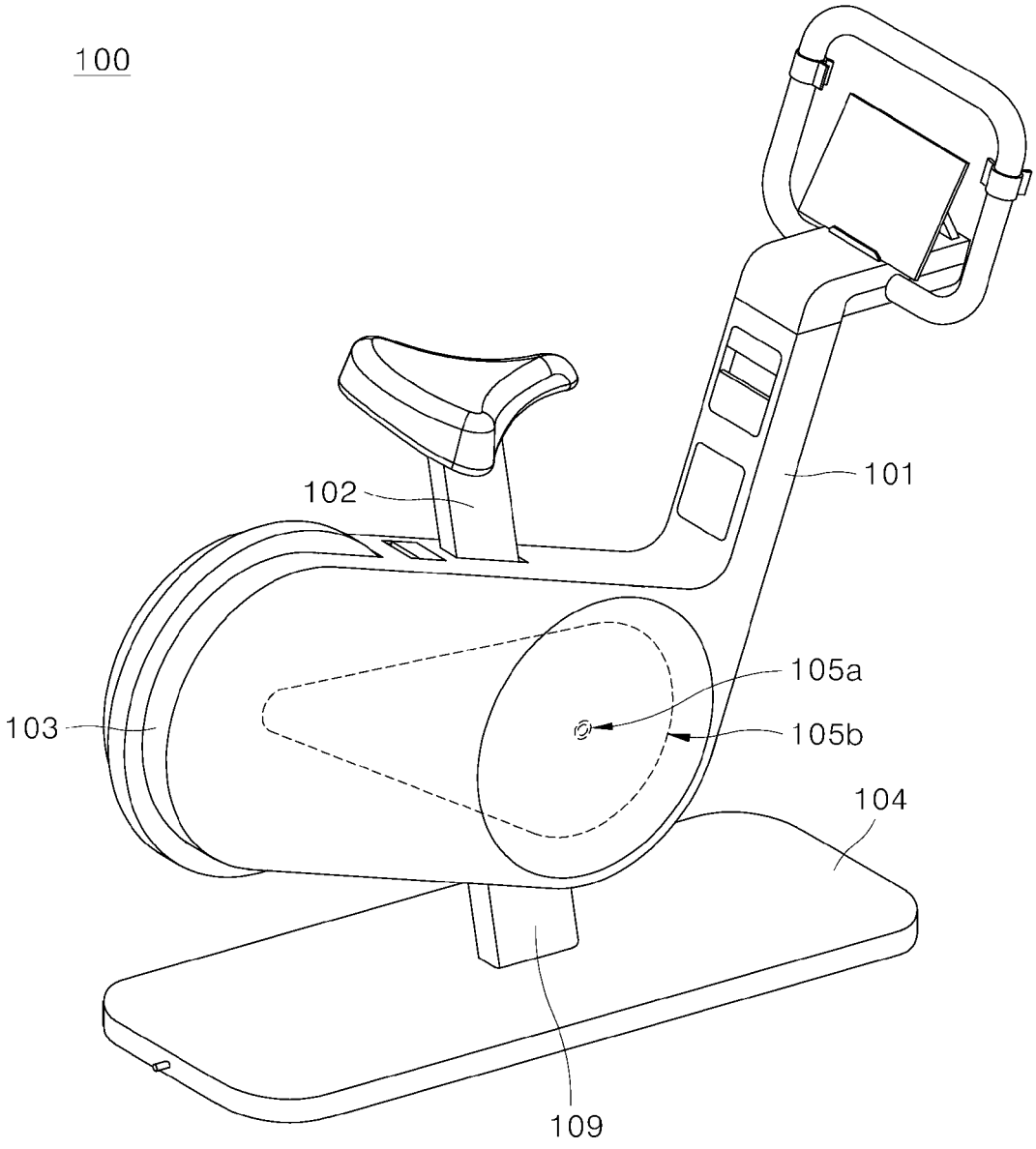

[Fig. 2]
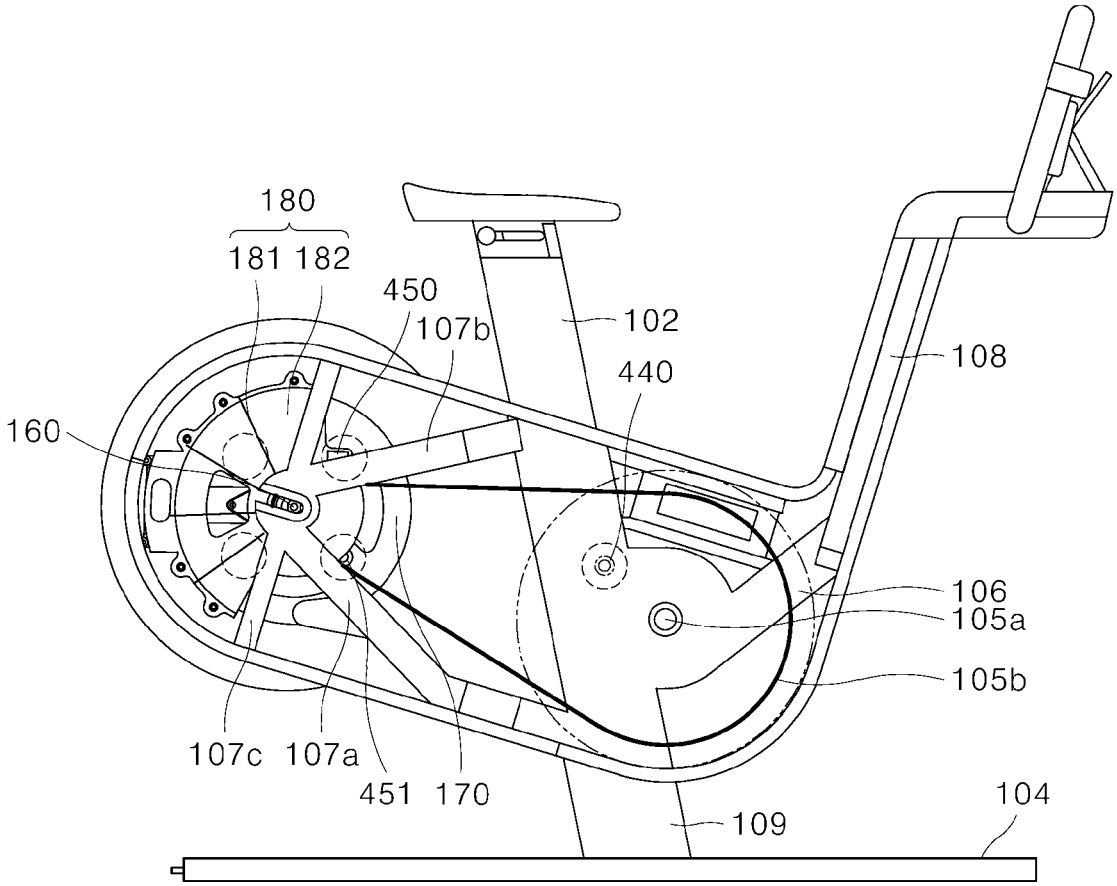

[Fig. 3]
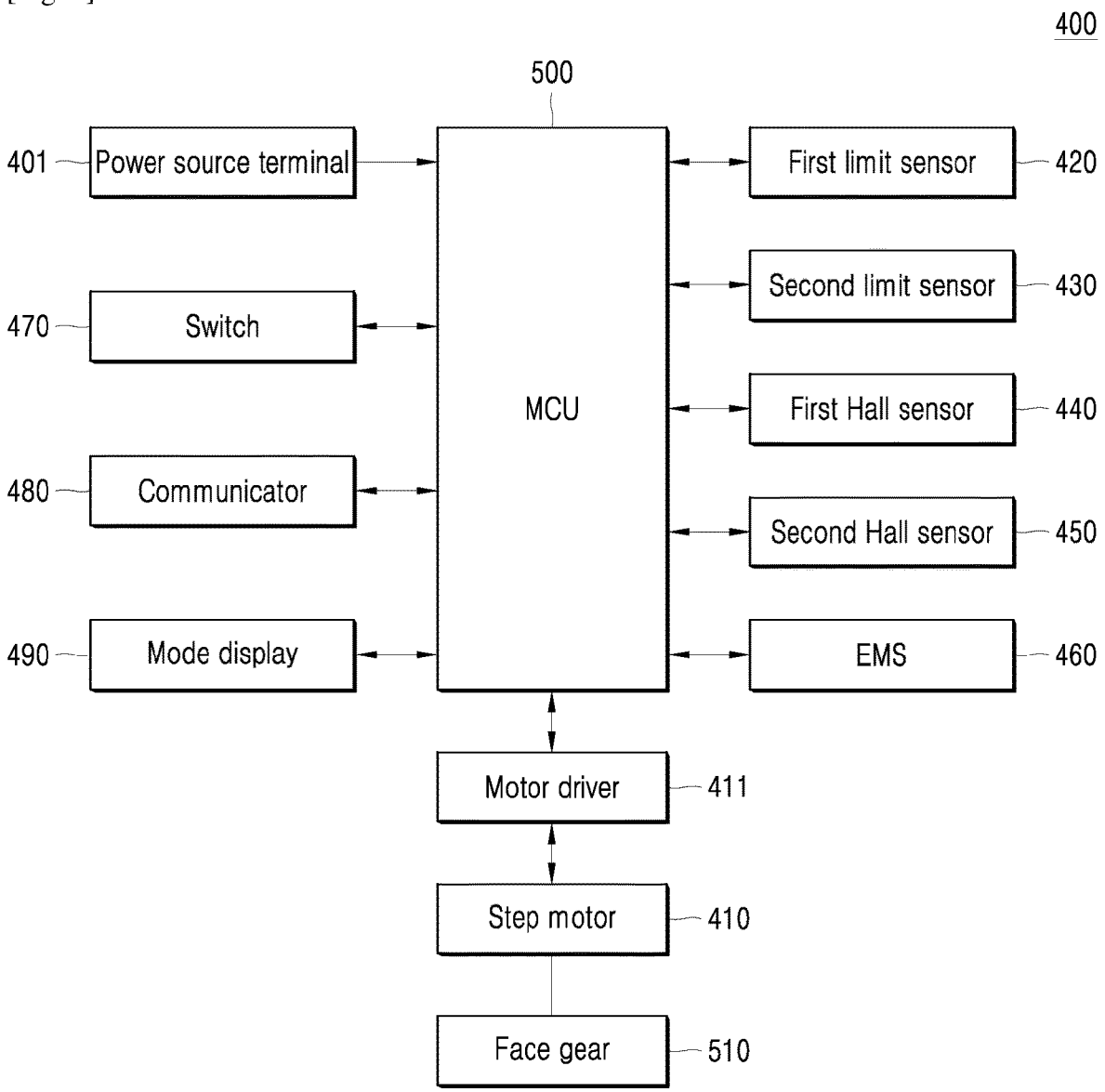

[Fig. 4]
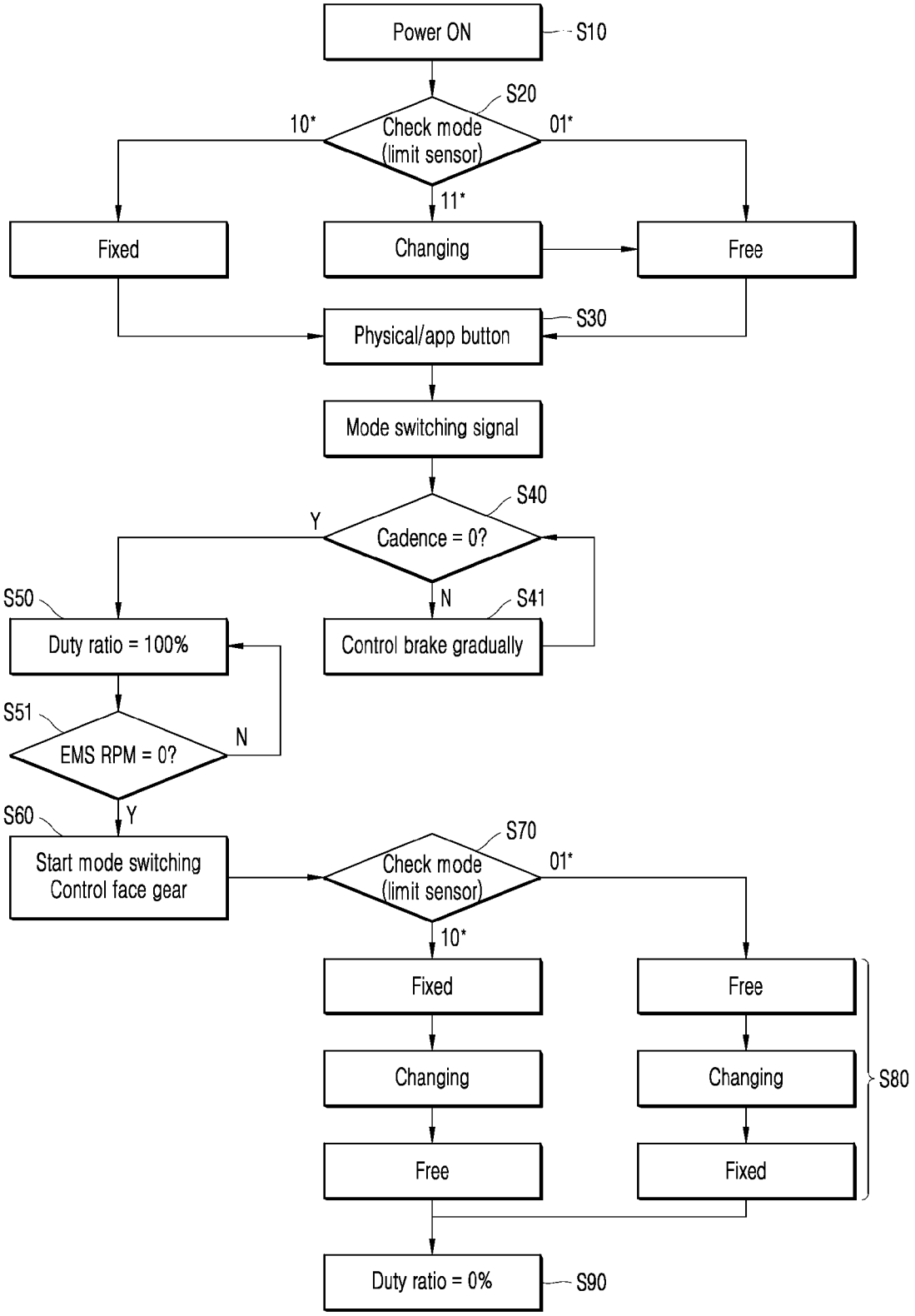

[Fig. 5]
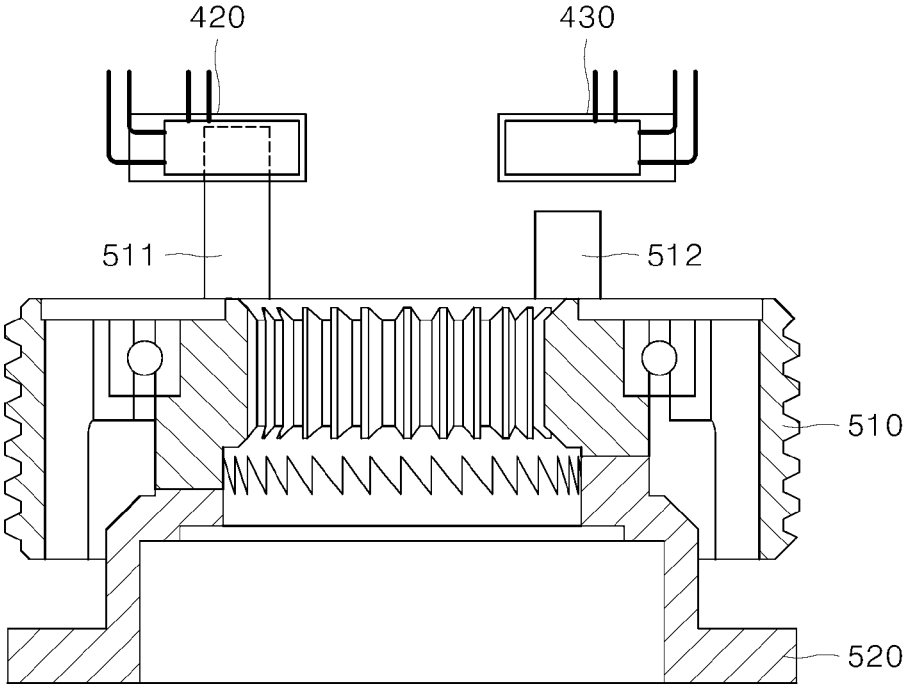
[Fig. 6]
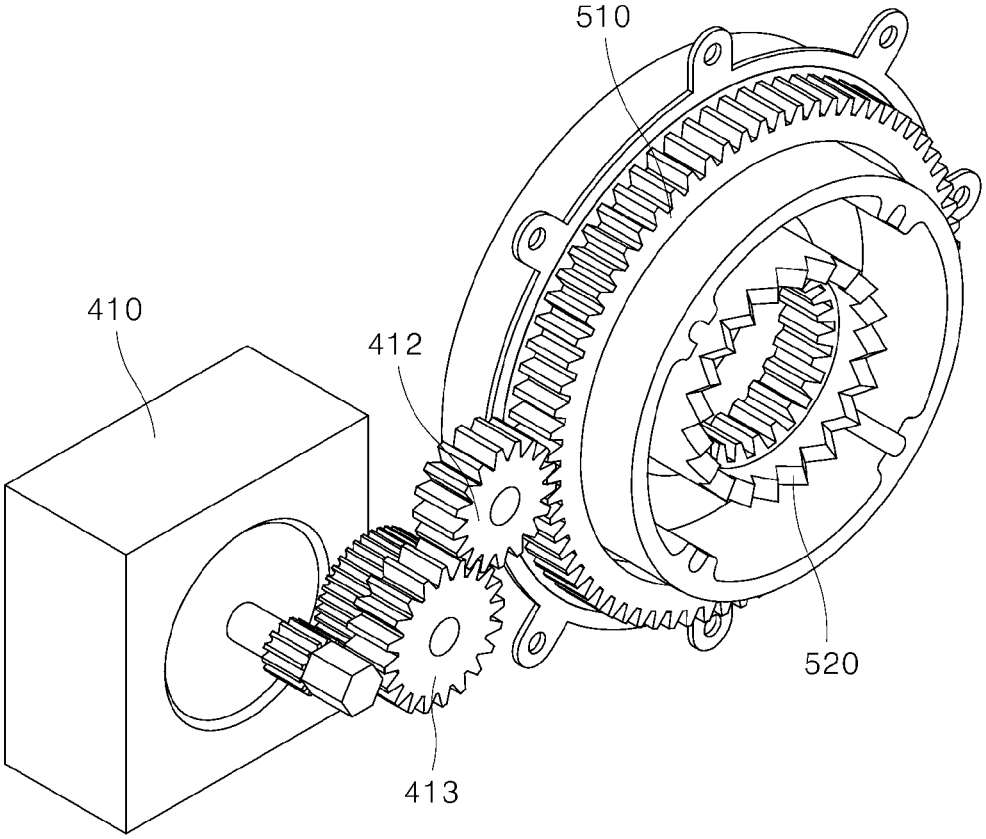

[Fig. 7]
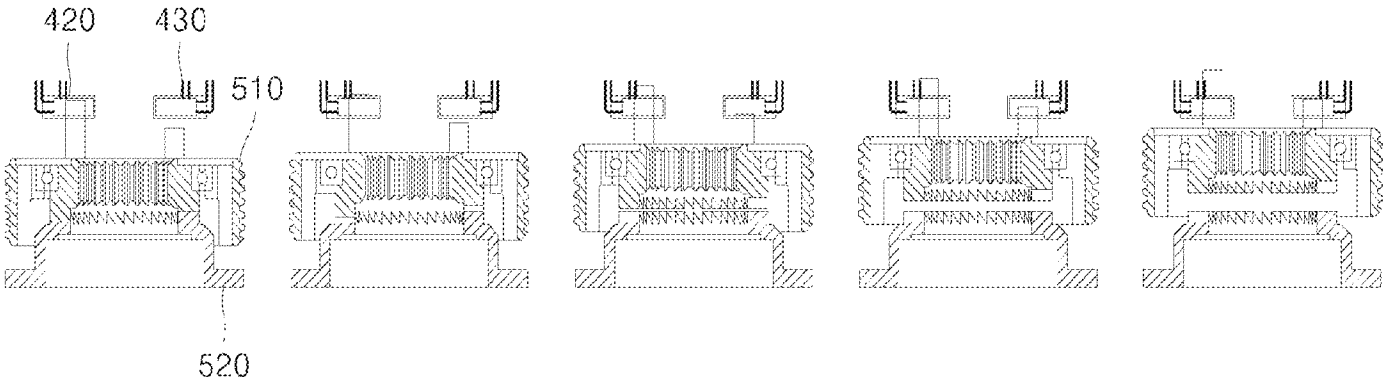

[Fig. 8]
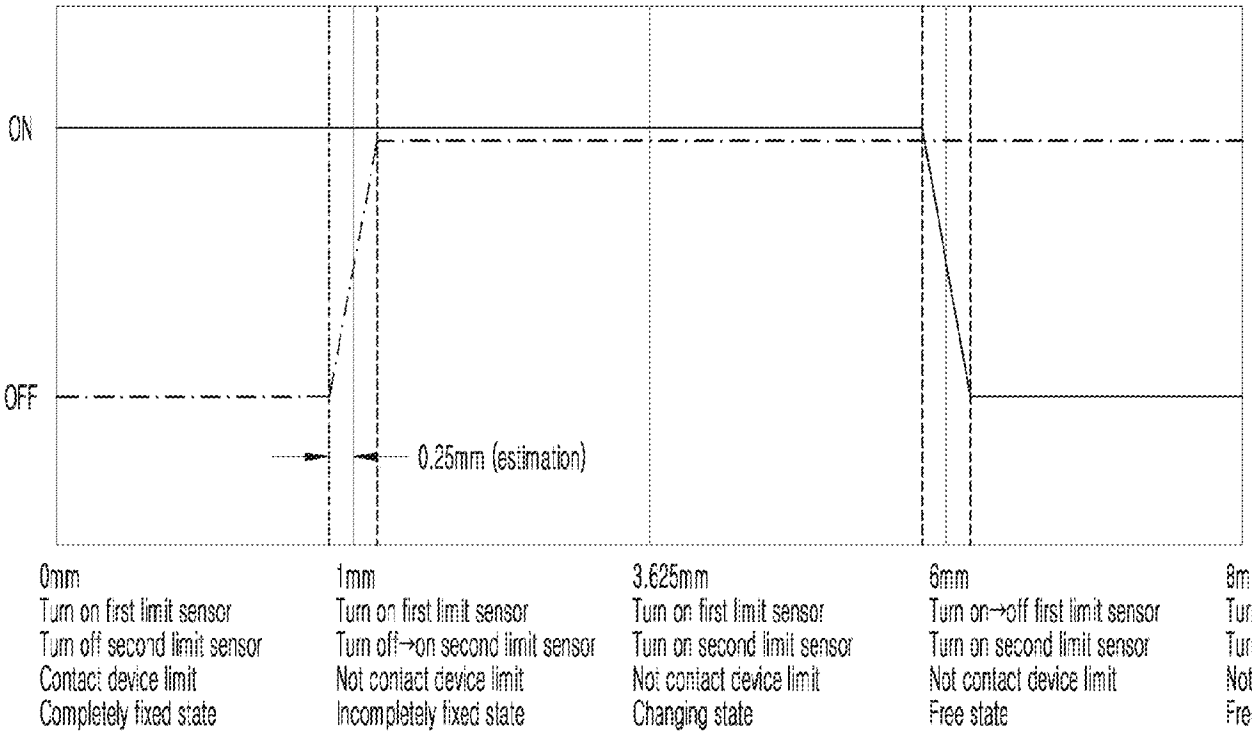

[Fig. 9]
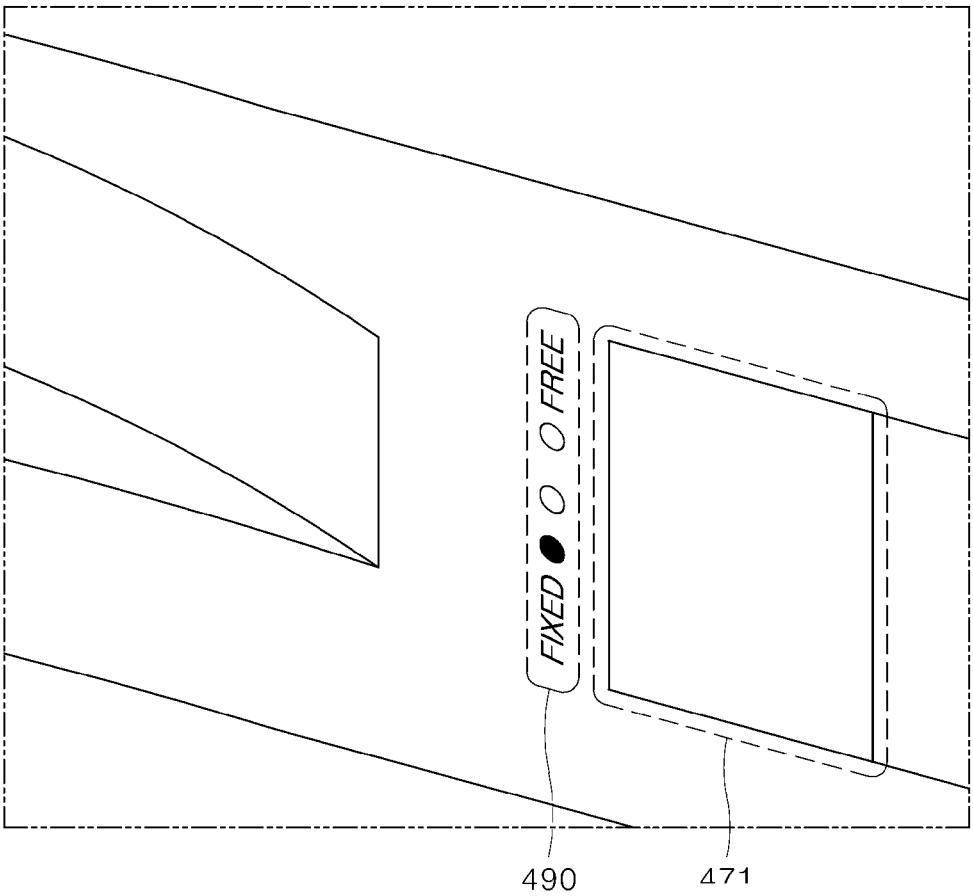
[Fig. 10]
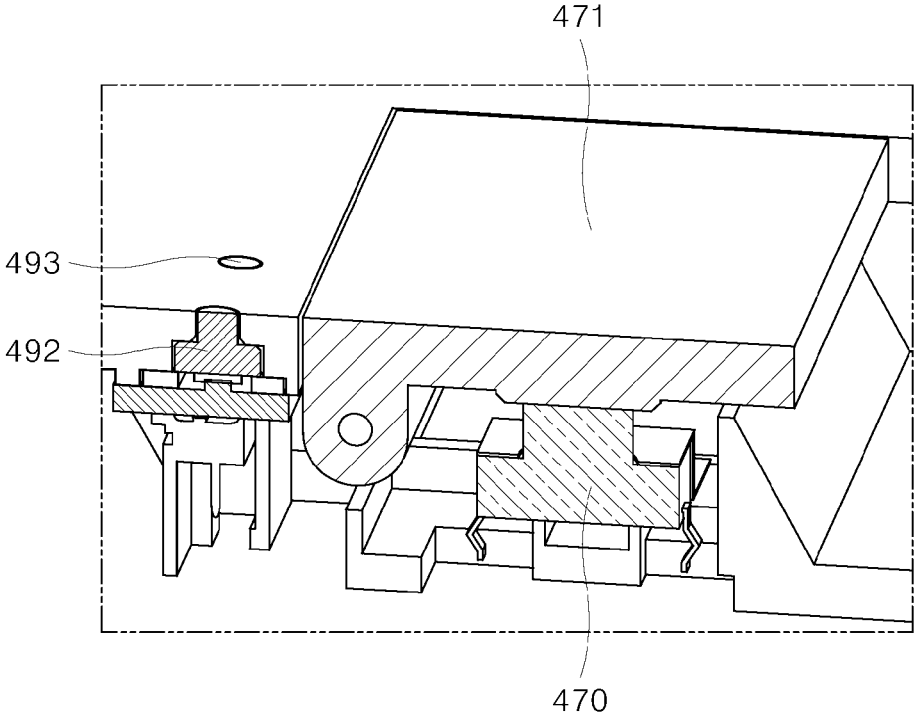

[Fig. 11]
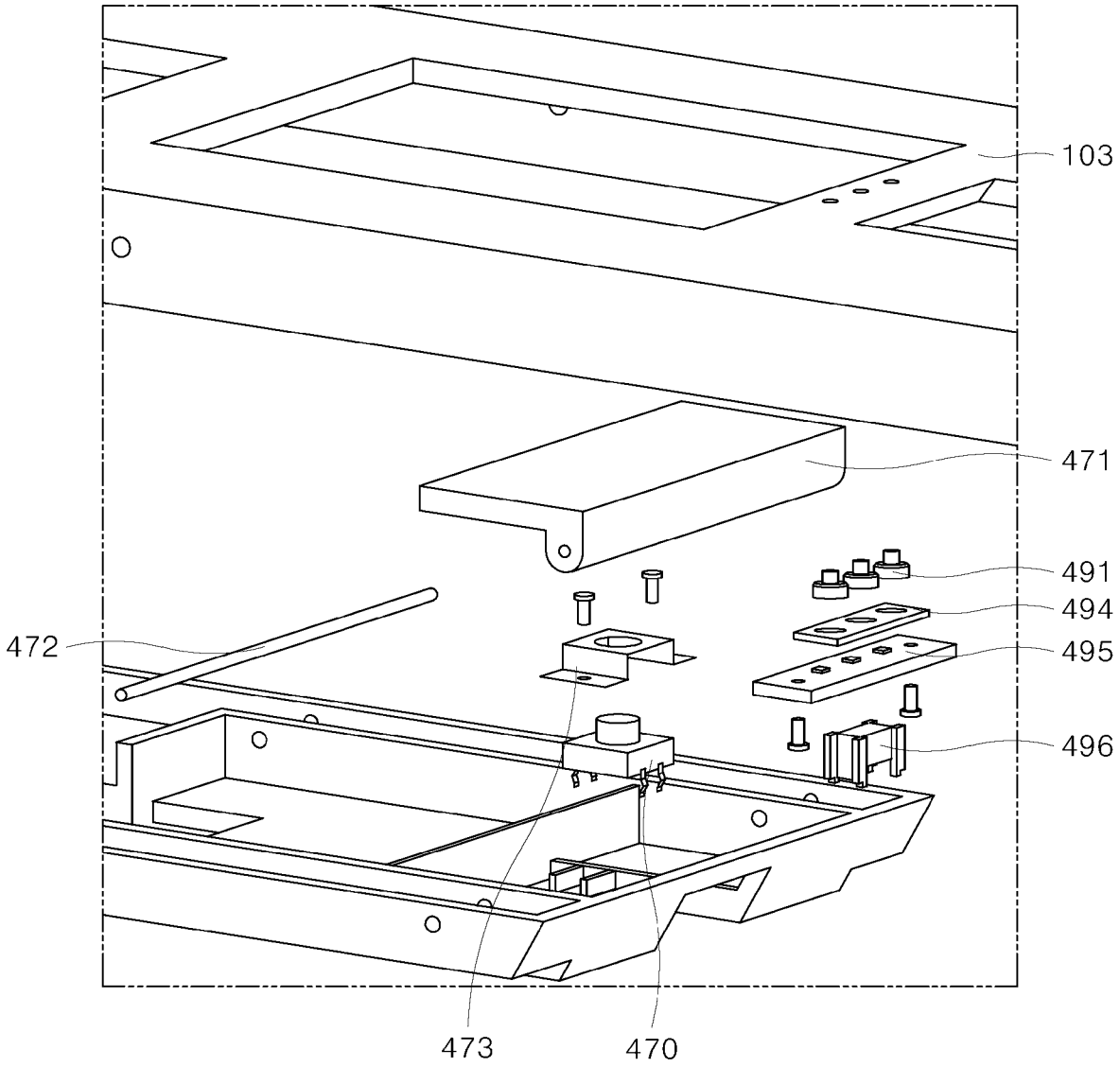
[Fig. 12]
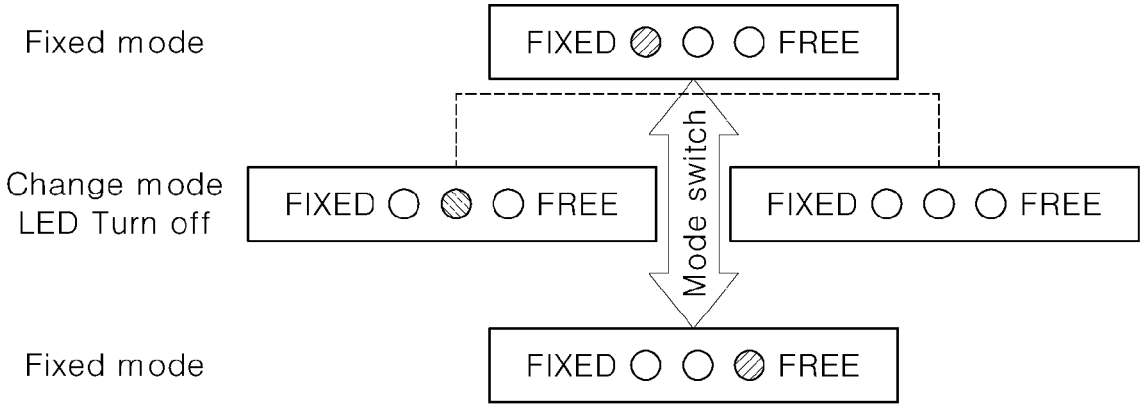

[Fig. 13]
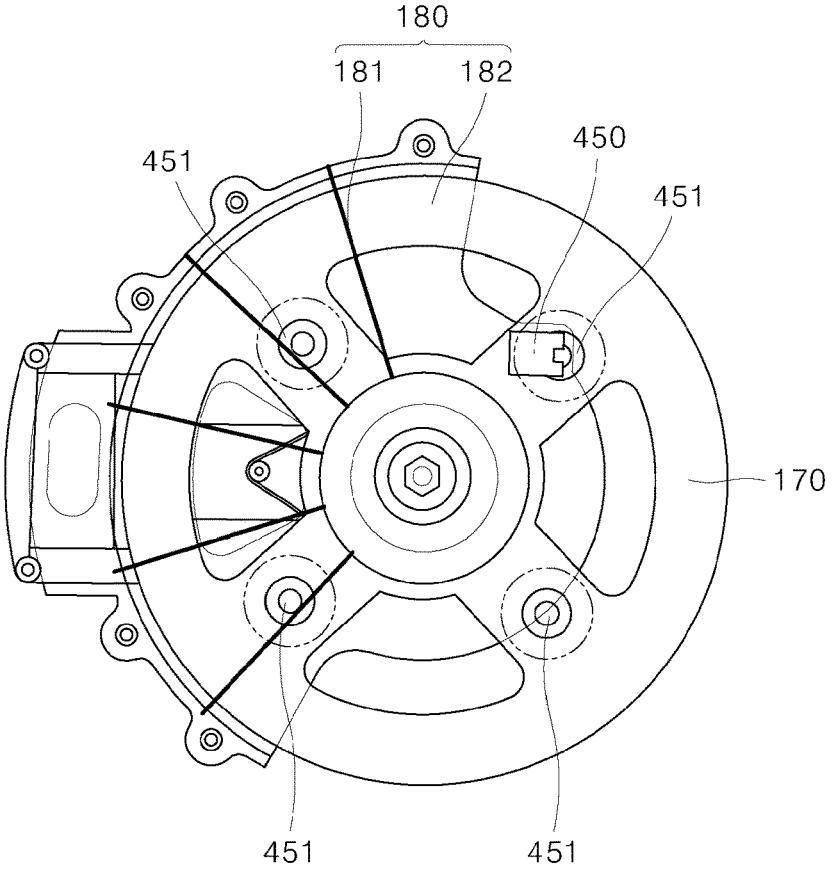
[Fig. 14]
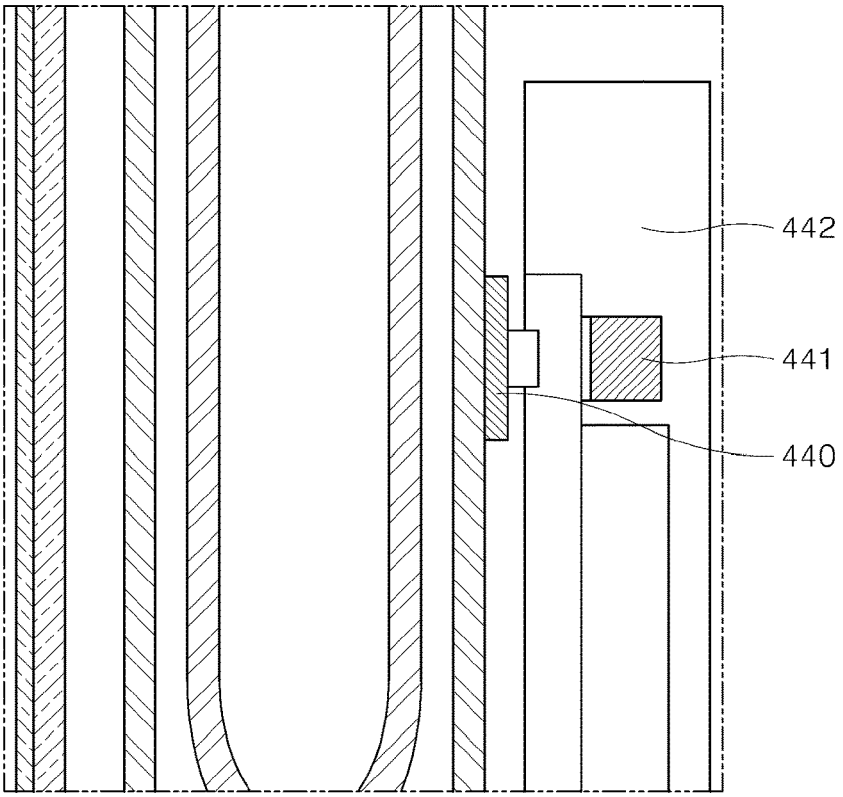

[Fig. 15]
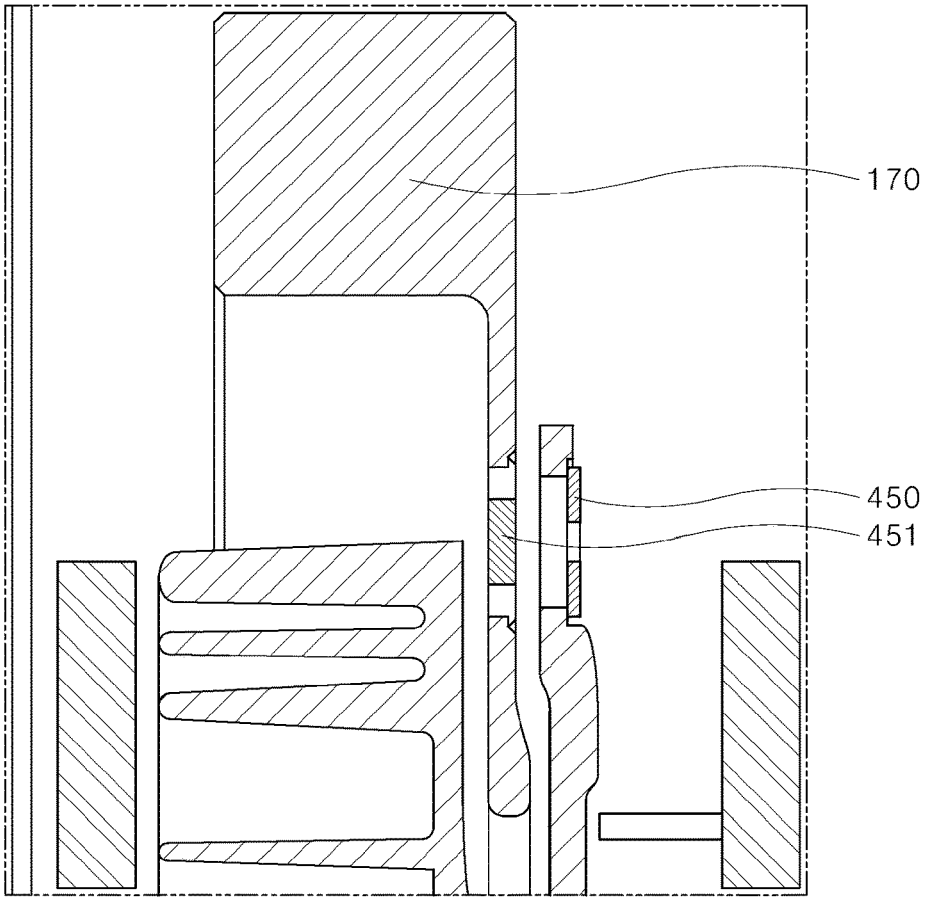
[Fig. 16]
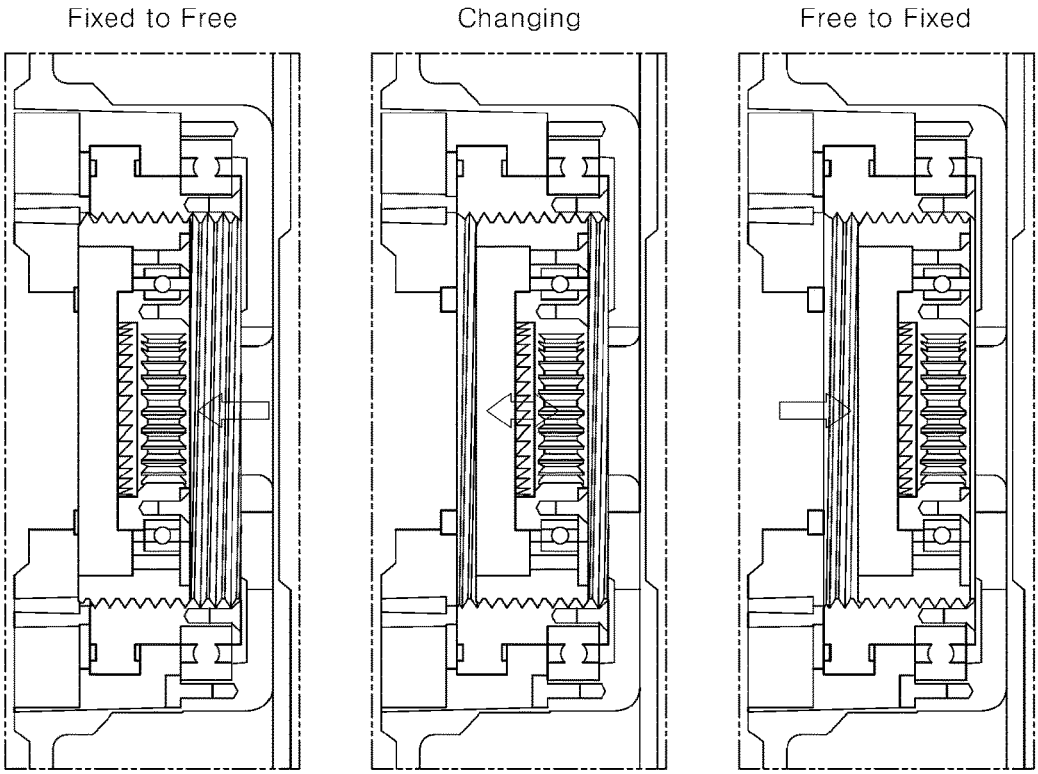

MODE SWITCHING SYSTEM AND EXERCISE BIKE COMPRISING THE SAME

CROSS REFERENCE TO RELATED APPLICATIONS

This application is the National Phase of PCT International Application No. PCT/KR2023/006791, filed on May 18, 2023, which claims priority under 35 U.S.C. 119 (a) to Patent Application No. 10-2022-0085032, filed in Republic of Korea on Jul. 11, 2022, all of which are hereby expressly incorporated by reference into the present application.

TECHNICAL FIELD

The present disclosure relates to an exercise bike, and in particular, a mode switching system and an exercise bike comprising the same that switches a non-freewheel mode and a freewheel mode automatically, thereby ensuring improvement in use convenience.

BACKGROUND ART

Ordinarily, exercise bikes for building muscles are used in indoor spaces. An exercise bike enables the user to exercise as the user pedals to rotate wheels.

Exercise bikes can be categorized into spinning bikes for spinning, and indoor bikes in which pedals rotate forward to rotate wheels. Spinning bikes adopt a non-freewheel structure, and indoor bikes adopt a freewheel structure.

In the case of a bike to which a non-freewheel structure is applied, power is transferred to wheels, when pedals rotate either forward or backward. In the case of a bike to which a freewheel structure is applied, power is transferred to wheels, only when pedals rotate forward.

In recent years, exercise bikes capable of selecting a mode in which the exercise bikes operate as a non-freewheel structure or a freewheel structure have been developed. For example, a fixed gear and a freewheel gear free switching crank set of a single-gear bike are disclosed in patent document 1 (KR Patent No. 10-1712711 registered on Feb. 27, 2017) as a prior art.

However, Patent Document 1 has a disadvantage in that it does not provide case of mode switching as a manual structure in which the crank arm is rotated in one direction selected from the upper and lower directions around the axis.

Additionally, patent document 1 does not suggest a component determining whether a current gear state is a fixed gear state or a freewheel gear state before a mode switch, failing to ensure accuracy and convenience in a mode switch.

Further, patent document 1 does not suggest a component that determines whether a crank and a fly wheel rotate, and based on results of the determination, stops the rotation of the crank and the fly wheel, before a mode switch, causing an accident caused by a mode switch.

Further, a drivetrain comprised of two divided shift gear mechanisms that are coupled through an intermediate gear mechanism is disclosed in patent document 2 (US2022/0111928 published on Apr. 14, 2022). Further, gear shifting for driving an additional bike driven by an electric motor is disposed in patent document 3 (CN108100147 registered on Sep. 28, 2021). Furthermore, a torque transistor and an electric bike with the torque transistor are disclosed in patent document 4 (CN113677589 published on Nov. 19, 2021).

Under the circumstances, technologies for enabling an easy mode switch between a non-freewheel structure and a freewheel structure and preventing an accident caused by a mode switch are needed for an exercise bike.

DISCLOSURE OF INVENTION

Technical Problem

The objective of the present disclosure is to provide a mode switching system and an exercise bike comprising the same that can ensure an easy mode switch between a non-freewheel structure and a freewheel structure, in the exercise bike.

The objective of the present disclosure is to provide a mode switching system and an exercise bike comprising the same that can prevent an accident caused by a mode switch.

The objective of the present disclosure is to provide a mode switching system and an exercise bike comprising the same that switches a non-freewheel mode and a freewheel mode automatically, thereby ensuring improvement in user convenience.

The objective of the present disclosure is to provide a mode switching system and an exercise bike comprising the same that can provide functions in relation to the improvement in user convenience such as a function of preventing an accident and an operational error, a function of controlling an app link using a Bluetooth function, and the like, considering different use scenarios resulting from an automatic mode switch.

The objective of the present disclosure is to provide a mode switching system and an exercise bike comprising the same that can determine a current mode state before a mode switches, and switch the mode after stopping the rotation of a crank and fly wheel, thereby ensuring a precise mode switch and preventing an accident.

The objective of the present disclosure is to provide a mode switching system and an exercise bike comprising the same that can allow the user to recognize a current mode state of the bike readily with the naked eye, and can give an instruction to switch a mode, based on a press of a physical button or a press of a software button.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Solution to Problem

A mode switching system and an exercise bike comprising the same, in one embodiment, may determine a current power transfer mode, and enable a switch to a non-freewheel mode or a freewheel mode, based on the current power transfer mode, at a time of switching a mode.

Specifically, as a mode switching signal is input, the mode switching system and the exercise bike comprising the same, in one embodiment, may sense a state of a face gear by using a first limit sensor and a second limit sensor, to determine a current power transfer mode. Based on the current power transfer mode, the mode switching system and the exercise bike may rotate a step motor forward or reversely, to ensure an easy switch to the non-freewheel mode or the freewheel mode.

The mode switching system and the exercise bike comprising the same, in one embodiment, may determine whether a crank and a fly wheel rotate, before a mode switch, and based on results of the determination, stop the rotation of the crank and fly wheel.

Specifically, before a mode switch, the mode switching system and the exercise bike comprising the same, in one embodiment, determine whether the crank rotates, through a first magnet being installed in the crank that connects to a pedal, and a first Hall sensor sensing magnet being installed in a disc that connects to the crank and sensing a rotation of the first magnet. Confirming that the crank rotates, the mode switching system and the exercise bike brake the crank gradually and stop the rotation of the crank.

Before a mode switch, the mode switching system and the exercise bike comprising the same, in one embodiment, determine whether the fly wheel rotates, through a second magnet being installed in a fly wheel of an EMS, and a second Hall sensor sensing a rotation of the second magnet. Confirming that the fly wheel rotates, the mode switching system and the exercise bike supply a power source to the EMS and stop the rotation of the fly wheel.

As the crank and the fly wheel stop rotating before a mode switch, an accident caused by the mode switch can be prevented.

The mode switching system and the exercise bike comprising the same, in one embodiment, switch the non-freewheel mode and the freewheel mode automatically through the step motor.

Specifically, the mode switching system and the exercise bike comprising the same, in one embodiment, fasten the face gear of the exercise bike to a wheel-face gear or separate the face gear from the wheel-face gear by using the step motor, to switch the power transfer mode to the non-freewheel mode or he freewheel mode automatically, ensuring improvement in user convenience.

The mode switching system and the exercise bike comprising the same, in one embodiment, delivers a mode switching signal based on a press of a button to a controller or receives an instruction from a smart terminal and provides a mode switching signal to the controller.

Specifically, the mode switching system and the exercise bike comprising the same, in one embodiment, may deliver a mode switching signal to the controller through a switch that delivers a mode switching signal based on a press of a button and a communicator that receives an instruction from a smart terminal, such that a physical button or a software button is pressed to give an instruction for a mode switch.

The mode switching system and the exercise bike comprising the same, in one embodiment, display a current power transfer mode state through a mode display.

The mode switching system and the exercise bike comprising the same, in one embodiment, display a current mode state through a first LED that is turned on in the non-freewheel mode, a second LED that is turned off at a time of switching from the non-freewheel mode to the freewheel mode or from the freewheel mode to the non-freewheel mode, and a third LED that is turned on in the freewheel mode, enabling the user to recognize the mode state readily with the naked eye.

The mode switching system of one embodiment comprises a step motor fastening a face gear of an exercise bike to a wheel-face gear or separating the face gear from the wheel-face gear, based on a driving signal, to switch a power transfer mode to a non-freewheel mode or a freewheel mode, a first limit sensor sensing a first part of the face gear and outputting a first sensing signal, a second limit sensor sensing a second part of the face gear and outputting a second sensing signal, and a controller determining a current power transfer mode by using the first sensing signal and the second sensing signal, and rotating the step motor forward or reversely, based on the current power transfer mode, to switch the power transfer mode to the non-freewheel mode or the freewheel mode, in a case where a mode switching signal is input.

In the embodiment, the mode switching system recognizes the completion of the mode switch by using the sensing signals of the first limit sensor and the second limit sensor, and recognizes whether a switch of the power transfer mode is completed, during a mode switch, and stops the step motor, releases a brake applied to a crank, and releases a brake applied to a fly wheel, in the case where the mode switch is completed.

The exercise bike of one embodiment comprises a mode switching system that determines a state of a current power transfer mode and switches the power transfer mode to a non-freewheel mode or a freewheel mode, as a mode switching signal is input. The mode switching system comprises a step motor fastening a face gear of the exercise bike to a wheel-face gear or separating the face gear from the wheel-face gear, based on a driving signal, to switch the power transfer mode to the non-freewheel mode or the freewheel mode, a first limit sensor sensing a first part of the face gear and outputting a first sensing signal, a second limit sensor sensing a second part of the face gear and outputting a second sensing signal, and a controller determining a current power transfer mode by using the first sensing signal and the second sensing signal, and rotating the step motor forward or reversely, based on the current power transfer mode, to switch the power transfer mode to the non-freewheel mode or the freewheel mode, in a case where the mode switching signal is input.

Advantageous Effects of Invention

As described above, a mode switching system and an exercise bike comprising the same, in one embodiment, sense the state of a face gear by using a limit sensor, to determine a current power transfer mode, and drive a step motor, based on the current power transfer mode, thereby ensuring an easy mode switch.

The mode switching system and the exercise bike comprising the same, in one embodiment, determine whether a crank and a fly wheel rotate, before a mode switch, and stop the rotation of the crank and the fly wheel, based on results of the determination, thereby preventing an accident caused by a mode switch.

The mode switching system and the exercise bike comprising the same, in one embodiment, fasten the face gear of the exercise bike to a wheel-face gear or separate the face gear from the wheel-face gear by using the step motor, to switch a power transfer mode automatically, thereby ensuring improvement in user convenience.

The mode switching system and the exercise bike comprising the same, in one embodiment, provide a mode switching signal based on a press of a button to a controller or receive an instruction from a smart terminal and provide a mode switching signal to the controller, such that an instruction for a mode switch is given based on a press of a physical button or a press of a software button.

The mode switching system and the exercise bike comprising the same, in one embodiment, display a current power transfer mode state through a mode display, enabling the user to readily recognize a mode state with the naked eye.

The mode switching system and the exercise bike comprising the same, in one embodiment, additionally provide functions in relation to the improvement in user convenience such as a function of preventing an accident and an operational error, a function of controlling an app link using a Bluetooth function, and the like, considering different use scenarios resulting from a mode switch.

The mode switching system and the exercise bike comprising the same, in one embodiment, enable the user to switch a mode readily and to recognize a mode state, preventing the user from switching a mode unreasonably, and an accident caused by failure and an operational error of the device.

The mode switching system and the exercise bike comprising the same, in one embodiment, prevent an accident at a time of switching a mode, and provide an EMS brake function for a precise mode switch.

Specific effects are described along with the above-described effects in the section of detailed description.

BRIEF DESCRIPTION OF DRAWINGS

FIG. 1 is a perspective view showing an exercise bike of one embodiment.

FIG. 2 is a side view showing the exercise bike of one embodiment.

FIG. 3 is a block diagram showing a mode switching system in the exercise bike of one embodiment.

FIG. 4 is a flowchart for describing the mode switching system in the exercise bike of one embodiment.

FIG. 5 is a view for describing a mode switch recognition in the exercise bike of one embodiment.

FIG. 6 is a view for describing a mode switch in the exercise bike of one embodiment.

FIG. 7 is a view showing a mode switch state in each stage, in the exercise bike of one embodiment.

FIG. 8 is a sensing graph based on a mode switch state in each stage, in the exercise bike of one embodiment.

FIG. 9 is a perspective view showing an LED and a physical button in the exercise bike of one embodiment.

FIG. 10 is a cross-sectional view showing the LED and the physical button in the exercise bike of one embodiment.

FIG. 11 is an exploded perspective view showing the LED and the physical button in the exercise bike of one embodiment.

FIG. 12 is a view showing that the LED lights up, based on a mode switch, in the exercise bike of one embodiment.

FIG. 13 is a view showing a Hall sensor installed in at an Electronic magnetic system (EMS), in the exercise bike of one embodiment.

FIG. 14 is a view showing a Hall sensor installed in at a crank, in the exercise bike of one embodiment.

FIG. 15 is a view showing a Hall sensor installed in at a fly wheel, in the exercise bike of one embodiment.

FIG. 16 is a view showing a pop-up window displayed on an application screen, at a time of switching a mode, in the exercise bike of one embodiment.

BEST MODE FOR CARRYING OUT THE INVENTION

The above-described aspects, features and advantages are specifically described hereafter with reference to accompanying drawings such that one having ordinary skill in the art to which the present disclosure pertains can embody the technical spirit of the disclosure easily. In the disclosure, detailed description of known technologies in relation to the subject matter of the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

Hereafter, a mode switching system that allows of an easy mode switch between a non-freewheel structure and a freewheel structure in an exercise bike, and an exercise bike comprising the same are described.

Additionally, a mode switching system that prevents accidents caused by a mode switch, and an exercise bike comprising the same are described.

Further, a mode switching system that automatically switches a non-freewheel mode and a freewheel mode, ensuring improvement in user convenience, and an exercise bike comprising the same are described.

Further, a mode switching system and an exercise bike comprising the same additionally provide functions in relation to the improvement in user convenience such as a function of preventing an accident and an operational error, a function of controlling an app link using a Bluetooth function, and the like, considering different use scenarios resulting from an automatic mode switch.

Further, a mode switching system and an exercise bike comprising the same may determine a current mode state before a mode switches, and switch the mode after stopping a rotation of a crank and a fly wheel, thereby ensuring a precise mode switch and preventing an accident.

Furthermore, a mode switching system and an exercise bike comprising the same may allow the user to recognize a current mode state of the bike readily with the naked eye, and give an instruction to switch a mode, based on a press of a physical button or a press of a software button.

In the disclosure, the non-freewheel structure or non-freewheel mode may be defined as a structure or mode in which power is transmitted to the flywheel and operated when the pedals of the exercise bike are rotated forward or reverse. Additionally, the non-freewheel mode may be referred to as a fixed mode.

In the disclosure, the freewheel structure or the freewheel mode may be defined as a structure or a mode in which power is delivered to a fly wheel only in the case where the pedals of an exercise bike rotate forward and in which power is not delivered to a fly wheel in the case where the pedals rotate reversely. Additionally, the freewheel mode may be referred to as a free mode.

FIG. 1 is a perspective view showing an exercise bike of one embodiment. FIG. 2 is a side view showing the exercise bike of one embodiment.

Referring to FIGS. 1 and 2, an exercise bike 100 comprises a base 104, a post 102, a body casing 103, a head casing 101, a front frame 106, rear frames 107*a*, 107*b*, 107*c*, a head frame 108, an EMS 460, a disc 105*b*, a stator 180 and a fly wheel 170.

The post 102 is elongated from the base 104 perpendicularly, and the height of the post 102 is adjustable. The post 102 may face rearward, at a predetermined angle.

The front frame 106 connects to the post 102. The front frame 106 may be elongated from the center of the post 102 forward and upward.

The head frame 108 connects to the front frame 106. The head frame 108 may be elongated from the end portion of the front frame 106 to face forward at a predetermined angle.

A stem connects to the upper portion of the head frame 108, and a handle and a display device connect to the stem.

The rear frames 107*a*, 107*b* connect to the post 102. Each of the rear frames 107*a*, 107*b* is elongated rearward, and the end portions of the rear frames 107*a*, 107*b* may be connected by the rear frame 107*c*.

Each of the frames supports a driving shaft 105*a* and a rotation shaft 160. The frames may be formed to have different structures, depending on the distributed load and structure of an exercise bike 100.

The body casing 103 and the head casing 101 may be installed to cover the outsides of the frames. Each of the frames, the fly wheel 170, a brake device (not illustrated) and the like are installed in the body casing 103 and the head casing 101.

The front and the rear of the body casing 103 may be rounded, and both sides of the body casing 103 in the left-right direction thereof may be formed into a planar plate. The disc 105*b* is formed at both sides of the body casing 103 in the left-right direction thereof.

The disc 105*b* is shaped into a circular panel. The body casing 103 and the disc 105*b* shield the frames, the fly wheel 170, the stator 180 and the like from the outside. Thus, users, infants and companion pets can be prevented from approaching to the frames, the flywheel 170, the stator 180 and the like, reducing the risk of personal injury.

The central portion of the disc 105*b* connects to both sides of the driving shaft 105*a*. Pedals are attached to the driving shaft 105*a* of the disc 105*b*, such that a rotating crank connects to the driving shaft 105*a* of the disc 105*b*.

The driving shaft 105*a* is installed in a way that the driving shaft 105*a* passes through the central portion of a driving wheel (not illustrated). The driving shaft 105*a* and the rotation shaft 160 are connected by a power transfer part (not illustrated) such as a belt or a chain. As the user pedals, the driving wheel rotates. As the driving wheel rotates, the driving shaft 105*a* and the rotation shaft 160 rotate.

The head casing 101 is elongated upward at the front side of the body casing 103. The head casing 101 is supported by the front frame 106 and the head frame 108. The head casing 101 connects to the stem.

The stem comprises a stem post that is coupled to the head casing 101 in a way that the height of the stem post is adjustable. A display may be disposed at the upper side of the stem. The display may display exercise information such as a speed, a rotational load and the like of the exercise bike 100. A handle connects to the upper side of the stem.

Since the upper side of the head casing 101 is inclined more toward the front side than the lower side, the higher the height of the stem is adjusted, the more the handle moves toward the front side. Accordingly, for a tall user, the height of the handle may be adjusted, such that the height and the front-rear distance of the handle 143 are adjusted to be fitted with the height of the user.

A seat tube is installed in the body casing 103. The seat tube 109 may be installed in a way that the seat tube 109 passes through the body casing 103. The seat tube 109 may be disposed to incline in the up-down direction of the body casing 103.

The seat tube 109 is disposed between the driving shaft 105*a* and the rotation shaft 160. The seat tube 109 may be formed into different shapes such as a polygonal pipe or a circular pipe and the like.

The post 102 is coupled to the inner portion of the seat tube 109 in a way that the height of the post 102 is adjustable. The upper end portion of the post 102 is disposed to incline further rearward than the lower end portion of the post 102. A seat on which the user can sit is disposed at the upper side of the post 102.

The seat post 102 may be installed in the seat tub 109 in a way that the height of the seat post 102 is adjustable. The seat post 102 may have different cross sections, depending on the shape of the seat tube 109.

Since the seat post 102 and the seat tube 109 are disposed to incline in the up-down direction, the seat becomes farther from the handle, as the height of the seat post 102 becomes higher. Accordingly, by increasing the height of the post 102 as the height of the user increases, the height of the seat and the handle and the front-back distance can be appropriately adjusted according to the height of the user.

The fly wheel 170 is coupled to the rotation shat 160. The rotation shaft 160 is coupled to the rotation center of the flywheel 170, and the rotation shaft 160 and the flywheel 170 connect to each other, with a one-way bearing (not illustrated) as a medium. The one-way bearing is disposed in a way that the rotation shaft 160 and the flywheel 170 form a concentric circle.

Additionally, the rotation shaft 160 and the fly wheel 170 may be limited by a clutch gear module (not illustrated) or released from limit of the clutch gear module. The clutch gear module may also be disposed in a way that the rotation shaft 160 and the flywheel 170 form a concentric circle. The flywheel 170 rotates in a freewheel mode and in a non-freewheel mode.

The freewheel mode denotes a driving mode in which the flywheel 170 is rotated by a binding force of the one-way bearing in the case where the rotation shaft 160 rotates forward, and does not rotate in the case where the rotation shaft 160 rotates reversely.

In the freewheel mode, the rotation shaft 160 rotates idly at the flywheel 170, at a time when the rotation shaft 160 rotates reversely.

The non-freewheel mode denotes a driving mode in which the flywheel 170 rotates in both the cases where the rotation shaft 160 rotates forward and where the rotation shaft 160 rotates reversely. In the non-freewheel mode, the rotation shaft 160 and the flywheel 170 are mutually locked by the clutch gear module and rotate together.

The stator 180 is installed in a frame part 120 and adjusts a rotation load of the flywheel 170 by applying a magnetic force to the flywheel 170. The stator 180 is an electromagnet where a coil 182 is wound around an iron core 181. As a power source is supplied to the coil 182, a magnetic force is generated in the stator 180. Current supplied to the coil 182 of the stator 180 is adjusted to adjust the magnitude of the magnetic force of the stator 180.

As the rotation load of the flywheel 170 (the magnitude of the magnetic force of the stator 180) increases, a pedal effort to pedal increases, and as the rotation load of the flywheel 170 (the magnitude of the magnetic force of the stator 180) decreases, a pedal effort to pedal decreases. Accordingly, the rotation load of the flywheel 170 is adjusted based on the adjustment of the magnitude of the magnetic force of the stator 180, such that the user's pedal effort is adjusted.

In the exercise bike 100 of the present disclosure, the flywheel 170 may be disposed at the rear side or the front side with respect to the driving shaft 105*a*. Depending on the position of the flywheel 170, the shapes of the frames and the casing may vary, and the positions of the driving shaft 105*a* and the rotation shaft 160 change.

In an example, the exercise bike 100 may comprise a flywheel and a motor assembly for reacting to conditions for a virtual environment as well as controlling resistance, and be used for various purposes such as outdoor simulation, a gameplay, training and the like.

In an example, the exercise bike 100 may comprise a flywheel and a motor assembly for reacting to conditions for a virtual environment as well as controlling resistance, and be used for various purposes such as outdoor simulation, a gameplay, training and the like.

A force supplied to the flywheel may be used to simulate a different gear ratio or gear shifting of an outdoor bike.

In the exercise bike 100, the wheels may be designed in the form of an EMS (Electronic magnetic system), and generate an electromagnetic force, based on a processor's adjustment of current, to allow the user to feel like the user is on an upward slope or a downward slope in a real field.

An exercise bike capable of switching a mode is embodied, to prevent inconvenience the user may experience.

A load of an EMS for safe mode switching needs to be controlled, and at a time of switching a mode, the EMS needs to stand still or the speed of the EMS needs to be at a first reference value (a low-speed RPM) or less, to control the movement of the face gear precisely.

Accidents, injuries and the like involving the pedaling of a bike, caused by a sudden stop, need to be prevented through a brake system ensuring a safe stop.

The exercise bike 100 can be controlled based on an exercise program desired by the user, since a mode switching button and a switch that are to select a freewheel mode or a non-freewheel mode are provided in the exercise bike.

The exercise bike 100 checks and measures the speeds of the wheels and pedals by using at least one or more Hall sensors, to prevent an accident caused by a mode switch.

In the exercise bike 100, the controller checks data corresponding to the speeds of the wheels and the pedals in real time, and switches a power transfer mode at a speed where the user stops exercise or less.

FIG. 3 is a block diagram showing a mode switching system in the exercise bike of one embodiment. FIG. 4 is a flowchart for describing the mode switching system in the exercise bike of one embodiment.

Referring to FIG. 3, the exercise bike 100 of one embodiment comprises a mode switching system 400.

The mode switching system 400 automatically switches the power transfer mode of the exercise bike 100 to the non-freewheel mode or the freewheel mode, based on the user's mode switching button input.

The mode switching system 400 comprises a step motor 410, a motor driver 411, a first limit sensor 420, a second limit sensor 430, a first Hall sensor 440, a second Hall sensor 450, an EMS 460, a mode switch 470, a communicator 480, a mode display 490, and a controller 500.

The step motor 410 rotates forward or reversely, to switch the power transfer mode of the exercise bike 100 to the non-freewheel mode or the freewheel mode. The step motor 410 fastens the face gear 510 to a wheel-face gear or separates the face gear 510 from the wheel-face gear, based on its forward rotation or reverse rotation.

The motor driver 411 drives the step motor 410, under the control of the controller 500. The controller 500 provides a clock signal and a direction signal for controlling the rotation speed and direction of the step motor 410 to the motor driver 411.

When the face gear 510 engages with the wheel-face gear, it means a fixed mode, and when the face gear 510 is released from the wheel-face gear, it means a free mode. The user can switch a mode by pressing the mode switching button.

The first limit sensor 420 senses a first part 511 of the face gear 510 and provides a first sensing signal to the controller 500, and the second limit sensor 430 senses a second part 512 of the face gear 510 and provides a second sensing signal to the controller 500.

The controller 500 determines a current power transfer mode by using the first sensing signal and the second sensing signal that are received from the first limit sensor 420 and the second limit sensor 430, as a mode switching signal is input to the controller 500.

Then the controller 500 rotates the step motor 410 forward or reversely, based on the current power transfer mode, to switch the power transfer mode to the non-freewheel mode or the freewheel mode.

The following table 1 shows a state truth table of the limit sensors.

TABLE 1

State truth table of limit sensor

| Mode | Limit sensor #1 | Limit sensor #2 |
|---|---|---|
| Fixed | 1 (ON) | 0 (OFF) |
| Changing | 1 (ON) | 1 (ON) |
| Free | 0 (OFF) | 1 (ON) |

As shown in table 1, the controller 500 determines a current power transfer mode by using the first sensing signal of the first limit sensor 420, and the first sensing signal of the second limit sensor 430.

For example, if the first detection signal and the logic level of the first detection signal are input as 1 and 0, the current mode is a fixed mode, and if the logic level is input as 0 and 1, the current mode is a free mode and the logic level If is input as 1, 1, the current mode is a mode conversion state.

In the controller 500, the step motor 410 rotates and changes a recognition state of the first limit sensor 420 and the second limit sensor 430, at a time of switching a mode. The controller 500 distinguishes modes, based on the state of the first limit sensor 420 and the second limit sensor 430, and embodies an automatic mode switch precisely and prevents an operational error.

Additionally, at a time of initial booting, in the case where the 쩐 is in a changing state, the 쩐 returns to a free mode. Depending on user settings, the 쩐 may switch to a fixed mode.

The controller 500 continues to check sensing signals of the first limit sensor 420 and the second limit sensor 430, in the changing state. The controller 500 blocks a mode switching button operation, in the changing state.

A first magnet is installed in at a crank connecting to a pedal. The first Hall sensor 440 is installed in a disc 105*b* connecting to the crank, and senses the rotation of the first magnet and provides a third sensing signal to the controller 500.

The controller 500 determines whether the cranks rotates, by using the third sensing signal of the first Hall sensor 440, before controlling a mode switch, and confirming that the crank rotates, brakes the crank gradually and stops the rotation of the crank.

Further, at least one or more second magnets are installed in at the fly wheel 170. The second Hall sensor 450 senses the rotation of the second magnet based on the rotation of the fly wheel 170, and outputs a fourth sensing signal to the controller 500.

The controller 500 determines whether the fly wheel 170 rotates, by using the fourth sensing signal, before controlling a mode switch, and confirming that the fly wheel 170 rotates, the controller supplies a power source to the stator 180 of the EMS 460 to stop the rotation of the fly wheel 170.

Further, the controller 500 checks the first sensing signal of the first limit sensor 420 and the second sensing signal of the second limit sensor 430, while the power transfer mode switches, to recognize the completion of the switch of the power transfer mode. The controller 500 stops the step motor 410. when recognizing the completion of the switch of the power transfer mode.

The mode switch 470 provides a mode switching signal based on the press of the button to the controller 500.

The mode display 490 is disposed near the button, and displays a current power transfer mode state. The mode display 490 displays a mode state, since the user cannot check the state of the gear inside the exercise bike 100, because of inherent characteristics regarding the design of the exercise bike 100.

The mode display 490 comprises a first LED 491 that is turned on in the non-freewheel mode, a second LED 492 that is turned off while the non-freewheel mode switches to the freewheel mode or the freewheel mode switches to the non-freewheel mode, and a third LED 493 that is turned on in the freewheel mode.

The communicator 480 communicates with a smart terminal that executes a program, an application and contents in relation to the exercise bike 100.

The communicator 480 receives an instruction corresponding to a mode switching signal from the smart terminal and provides the instruction to the controller 500, and transmits a signal corresponding to the completion of a mode switch to the smart terminal.

In an example, an app button of the smart terminal operates at a time of a Bluetooth connection, and is inactivated or enters into a Bluetooth pairing scenario at a time of a Bluetooth disconnection. The mode switching system 400 links the controller 500 with each sensor, state information and mode switch instruction data, at a time of a Bluetooth connection with the smart terminal.

An example of a mode switch operation of the mode switching system 400 is described as follows.

Referring to FIG. 4, in the case where a 24V adaptor power source is fastened to a power source terminal 401 of the exercise bike 100, the mode switching system 400 initializes each sensor (S10), as the controller 500 boots.

The mode switching system 400 checks whether a current mode is the fixed mode (the non-freewheel mode) or the free mode (the freewheel mode), by using the sensing signals of the first limit sensor 420 and the second limit sensor 430 (S20).

At this time, in the case where the mode switching system 400 senses the current mode as 1 and 1 that indicate the modes of the first limit sensor 420 and the second limit sensor 430 switch, the mode switching system 400 switches the current mode to the free mode.

The mode switching system 400 checks the press of the physical or app button after checking the current mode (S30).

The mode switching system 400 checks whether the pedals rotate, by using the first Hall sensor 440 that is disposed near the pedal (or the crank), as a mode switching signal is input based on the press of the physical or app button (S40).

The mode switching system 400 brakes the pedals gradually, to prevent injuries caused by pedaling, in the case where the pedals rotate (S41).

The mode switching system 400 supplies a power source to the EMS 460 at a maximum level, to stop the rotation of the pedals, in the case where the pedals stop and the fly wheel 270 rotates. In an example, a power source is supplied to the EMS 460 at a duty ratio of 100%, to generate an electromagnetic force, and stops the rotation of the fly wheel 170 (S50).

Confirming that the fly wheel 170 stops rotating (S51), the mode switching system 400 drives the step motor 410 and starts mode switching (S60). Herein, mode switching may be defined as a switching operation in which the free mode switches to the fixed mode by fastening the face gear to the wheel-face gear, or the fixed mode switches to the free mode by decoupling the face gear from the wheel-face gear.

In an example, the controller 500 delivers a clock signal and a direction signal to the moor driver 411, to make a speed constant, after enabling. The step motor 410 rotates reversely or forward, depend on the driving of the motor driver 411, and the face gear 510 rotates forward or backward depending on the rotation of the step motor 410 (S60).

The controller 500 receives the first sensing signal and the second sensing signal respectively from the first limit sensor and the second limit sensor, to check a switched mode state, during mode switching (S70).

The controller 500 stops the driving of the step motor 410, when recognizing a switch to the fixed mode or the free mode, based on the first sensing signal of the first limit sensor and the second sensing signal of the second limit sensor.

The Face gear is fastened to or separated from the wheel-face gear, based on the rotation of the wheel gear caused by a power transfer to the wheel gear, which is based on the rotation of the step motor 410. As the face gear is fastened to or separated from the wheel-face gear, the power transfer mode switches from the fixed mode to the free mode or from the free mode to the fixed mode (S80).

When the power transmission mode conversion is completed, the controller 500 applies power to the EMS with a duty ratio of 0%, that is, releases the electromagnetic force so that the flywheel 170 can rotate according to the power (S90).

Additionally, the mode switching system 400 may display power transfer mode states as a fixed mode, the middle of switch, and a free mode respectively, by using an external LED 3EA.

FIG. 5 is a view for describing a mode switch recognition in the exercise bike of one embodiment. FIG. 6 is a view for describing a mode switch in the exercise bike of one embodiment. FIG. 7 is a view showing a mode switch state in each stage, in the exercise bike of one embodiment. FIG. 8 is a sensing graph based on a mode switch state in each stage, in the exercise bike of one embodiment.

Referring to FIGS. 5 to 8, at a time of switching a mode, the step motor 410 rotates to change the recognition state of the first limit sensor 420 and the second limit sensor 430.

Mode are distinguished based on the state of the first limit sensor 420 and the second limit sensor 430, to embody an automatic mode switch precisely and prevent an operational error.

Specifically, the mode switching system 400 drives the step motor 410 and fastens the face gear 510 to the wheel-face gear 520, to switch the free mode to the fixed mode, or separates the faced gear 510 from the wheel-face gear 520, to switch the fixed mode to the free mode.

The step motor 410 rotates reversely or forward, based on the driving of the motor driver 411, and based on the rotation of the step motor 410, the face gear 510 rotates forward or backward. Herein, a first gear 412 and a second gear 413 may be included between the step motor 410 and the face gear 510, and transfer power.

The face gear 510 is fastened to the wheel-face gear 520 while rotating forward, and the face gear 510 is separated from the wheel-face gear 520 while rotating backward.

A mode state can be checked based on the logic state of the first sensing signal of the first limit sensor 420 and the logic state of the second sensing signal of the second limit sensor 430.

In an example, the controller 500 may determine that the face gear 510 is fastened and fixed completely to the wheel-face gear 520 in the case where the logic states of the first sensing signal and the second sensing signal are 1 and 0.

Additionally, the controller 500 may determine that the face gear 510 is partially separated from the wheel-face gear 520 and fixed to the wheel-face gear 520 incompletely, in the case where the logic state of the first sensing signal is 1 and the logic state of the second sensing signal switches from 0 to 1.

Further, the controller 500 may determine that the face gear 510 is in a changing state where the face gear 510 is being separated from the wheel-face gear 520, in the case where the logic state of the first sensing signal and the logic state of the second sensing signal are 1 and 1.

Further, the controller 500 may determine that the face gear 510 is in a free state where the face gear 510 is separated from the wheel-face gear 520, in the case where the logic state of the first sensing signal switches from 1 to 0, and the logic state of the second sensing signal is 1.

Further, the controller 500 may determine that the face gear 510 is separated from the wheel-face gear 520 completely, in the case where the logic state of the first sensing signal and the logic state of the second sensing signal are 0 and 1.

The exercise bike 100 of the embodiment may check a mode state, based on the logic state of the first sensing signal of the first limit sensor 420 and the second sensing signal of the second limit sensor 430.

Additionally, the exercise bike 100 of the embodiment may stop the driving of the step motor 410 as the exercise bike 100 recognizes a switch to the fixed mode or the free mode, based on the first sensing signal of the first limit sensor and the second sensing signal of the second limit sensor, thereby embodying an automatic mode switch precisely and preventing an operational error.

FIG. 9 is a perspective view showing an LED and a physical button in the exercise bike of one embodiment. FIG. 10 is a cross-sectional view showing the LED and the physical button in the exercise bike of one embodiment. FIG. 11 is an exploded perspective view showing the LED and the physical button in the exercise bike of one embodiment. FIG. 12 is a view showing that the LED lights up, based on a mode switch, in the exercise bike of one embodiment.

Referring to FIGS. 9 to 11, the physical button 471 and the mode display 490 are installed in the body casing 103 of the exercise bike 100. In an example, the physical button 471 and the mode display 490 may be installed in a position corresponding to the position of a top tube of the exercise bike.

As the physical button 471 is pressed, the physical button 471 contacts the mode switch and provides a mode switching signal to the controller 500.

A button assembly comprises a physical button 471, a shaft 472, a frame contact terminal 473, and a mode switch 470. In the button assembly, the frame contact terminal 473 presses the mode switch 470, and the mode switch 470 is turned on, as the user presses the physical button 471. As the mode switch 470 is turned on, a mode switching signal is transferred to the controller 500.

The mode display 490 is installed in the top tube of the exercise bike, near the physical button 471, and displays a current mode state. The mode display 490 display a mode state to allow the user to recognize a current mode state since the user cannot recognize the state of the state of the gear inside the exercise bike 100 because of inherent characteristics regarding the design of the exercise bike 100.

The mode display 490 comprises a first LED 491, a second LED 492, a third LED 493, a louver cap 494 which protects the LEDs, a PCB 495 on which the LEDs are mounted, a connector 496 which delivers the power source of the LED, and a screw for fixing to the body casing.

Referring to FIG. 12, the first LED 491 is turned on in the non-freewheel mode, the second LED 492 is turned off during a switch from the non-freewheel mode to the freewheel mode or a switch from the freewheel mode to the non-freewheel mode, and the third LED 493 a is turned on in the freewheel mode, for example.

FIG. 13 is a view showing a Hall sensor installed in at an electronic magnetic system (EMS), in the exercise bike of one embodiment. FIG. 14 is a view showing a Hall sensor installed in a crank, in the exercise bike of one embodiment. FIG. 15 is a view showing a Hall sensor installed in a fly wheel, in the exercise bike of one embodiment.

Referring to FIGS. 13 and 15, a second magnet 451, used to sense whether the fly wheel 170 rotates, may be installed in the fly wheel 170 of the EMS of the exercise bike 100. In an example, four second magnets 451 may be installed in the fly wheel 170.

The second Hall sensor 450 senses the rotation of the second magnet 451 and delivers a fourth sensing signal to the controller 500.

The controller 500 determines whether the fly wheel 170 rotates, by using the fourth sensing signal of the second Hall sensor 450.

In the case where the controller 500 determines that the fly wheel 170 rotates, the controller 500 supplies a power source of a 100% duty ratio to the EMS to stop the rotation of the fly wheel 170. Specifically, the controller 500 supplies a power source to a coil to generate an electromagnetic force, and increases the magnitude of resistance of the EMS to stop the rotation of the fly wheel 170.

As a mode switching signal is input, the controller 500, as described above, senses whether the fly wheel 170 rotates, by using the second Hall sensor 450, and in the case where the fly wheel 170 rotates, stops the rotation of the fly wheel 170 before a mode switch.

Referring to FIG. 14, a first magnet 441, used to sense whether a crank 442 rotates, is installed in the crank 442 connecting to the pedal of the exercise bike 100. The first Hall sensor 440 is installed in the disc **105*b* connecting to the crank 442, senses the rotation of the first magnet 441 and delivers a third sensing signal to the controller 500**.

The controller 500 determines whether the crank 442 rotates, by using the third sensing signal to the first Hall sensor 440, and confirming that the crank 442 rotates, the controller brakes the crank 442 gradually, and stops the rotation of the crank 442.

As a mode switching signal is input, the controller 500, as described above, senses whether the crank 442 rotates, by using the first Hall sensor 440, and in the case where the crank 442 rotates, stops the rotation of the crank 442 gradually before a mode switch.

FIG. 16 is a view showing a pop-up window displayed on an application screen, at a time of switching a mode, in the exercise bike of one embodiment.

The mode switching system 500 of the exercise bike 100 communicates with a smart terminal to execute a program, an application and contents in relation to the exercise bike 100.

The mode switching system 500 receives an instruction corresponding to a mode switching signal from the smart terminal to control all switching, and transmits a mode switch completion signal to the smart terminal.

In an example, the smart terminal communicates with the mode switching system 500, to allow the user to recognize an operation of switching the mode of the exercise bike, e.g., to allow the user to visually recognize a state in which the fixed mode is switched to the free mode, a changing state, and a state in which the free mode is switched to the fixed mode.

Additionally, an app button for a mode switch of the smart terminal is activated, and each sensor, state information and instruction data of the smart terminal are linked, as the smart terminal Bluetooth-connects to the mode switching system 500 of the exercise bike 100.

The mode switch operation of the exercise bike 100 is described as follows.

As a power source is supplied to the power source terminal 401 of the exercise bike 100, the controller 500 initializes each of the sensors while booting. Then the controller 500 checks a current mode state by using the sensing signals of the first limit sensor 420 and the second limit sensor 430.

After checking the current mode state, the controller 500 checks whether a mode switching signal is input. The mode switching signal is input through a button provided at the body case of the exercise bike 100 or the app button of the smart terminal.

After confirming that the mode switching signal is input, the controller 500 checks whether the crank 442 rotates, by using the first Hall sensor 440, and brakes the crank 442 gradually in the case where the crank 442 rotates, to prevent injuries caused by pedaling.

Further, the controller 500 checks whether the fly wheel 170 rotates, by using the second Hall sensor 450, and in the case where the fly wheel 170 rotates, supplies a power source to the EMS 460 at a maximum level, to stop the rotation of the fly wheel 170.

After confirming that the crank 442 and the fly wheel 170 are stopped, the controller 500 drives the step motor 410 and fastens the face gear 510 to the wheel-face gear 520 to switch from the free mode to the fixed mode or separates the face gear 510 from the wheel-face gear 520 to switch the fixed mode to the free mode.

In an example, the controller 500 rotates the step motor 410 forward to fasten the face gear 510 to the wheel-face gear 520, and rotates the step motor 410 reversely to separate the face gear 510 from the wheel-face gear 520.

Further, the controller 500 checks a switched mode state, based on sensing of the face gear 510 performed by the first limit sensor 420 and the second limit sensor 430, while driving the step motor 410.

Further, after confirming that the first sensing signal and the second sensing signal sensed through the first limit sensor 420 and the second limit sensor 430 are in a target logic state, the controller 500 stops the driving of the step motor 410. The controller 500 releases a brake applied to the crank 442, and takes an electromagnetic force out of the EMS, to rotate the crank 442, thereby enabling the fly wheel 170 to rotate.

Further, the controller 500 turns on at least one of the first LED 491, the second LED 492, and the third LED 493, which corresponds to a current mode state, through the mode display 490.

The mode switching system 500 and the exercise bike 100 comprising the same, in the embodiment, comprise a step motor 410 that fastens the face gear 510 of the exercise bike 100 to the wheel-face gear 520 or separates the face gear 510 from the wheel-face gear 520, based on a driving signal, to switch the power transfer mode to the non-freewheel mode or the freewheel mode, a first limit sensor 420 that senses the first part 511 of the face gear 510 and outputs the first sensing signal, a second limit sensor 430 that senses the second part 512 of the face gear 510 and outputs the second sensing signal, and a controller 500 that determines a current power transfer mode by using the first sensing signal and the second sensing signal in the case where a mode switching signal is input, and rotates the step motor 410 forward or reversely to switch the power transfer mode to the non-freewheel mode or the freewheel mode.

In the embodiment, the mode switching system 400 further comprises a first magnet 441 that is installed in the crank 442 connecting to the pedals of the exercise bike 100, and a first Hall sensor 440 that is installed in the disc 105*b* connecting to the crank 442, senses the rotation of the first magnet 441 and outputs the third sensing signal to the controller 500.

In the embodiment, the mode switching system 400 determines whether the crank 442 rotates, before a mode switch, and confirming that the crank 442 rotates, the controller brakes the crank 442 gradually to stop the rotation of the crank 442.

In the embodiment, the mode switching system 400 further comprises a second Hall sensor 450 that senses the second magnet 451 installed in at the fly wheel 170 of the EMS of the exercise bike 100, and the rotation of the second magnet 451, and outputs the fourth sensing signal to the controller.

In the embodiment, the mode switching system 400 determines whether the fly wheel 170 rotates before a mode switch, and confirming that the fly wheel 170 rotates, the controller supplies a power source to the EMS to stop the rotation of the fly wheel 170.

In the embodiment, the mode switching system 400 recognizes the completion of a mode switch, by using the sensing signals of the first limit sensor 420 and the second limit sensor 430 during the mode switch, and after the mode switch is completed, the controller stops the step motor 410*a*, releases a brake applied to the crank 442 and releases a brake applied to the fly wheel 170.

The mode switching system 400 and the exercise bike 100 comprising the same, in one embodiment, sense the state of the face gear 510, by using the limit sensor 420, 430, to determine a current power transfer mode, and based on the current power transfer mode, the controller drives the step motor 410, ensuring an easy mode switch.

Additionally, the mode switching system 400 and the exercise bike 100 comprising the same, in one embodiment, determine whether the crank and the fly wheel 170 rotate before a mode switch, and based on results of the determination, the controller stops the rotations of the crank and the fly wheel 170, preventing an accident caused by a mode switch.

Further, the mode switching system 400 and the exercise bike 100 comprising the same, in one embodiment, fasten the face gear 510 of the exercise bike 100 to the wheel-face gear 520 or separate the face gear 510 from the wheel-face gear 520 by using the step motor 410, to switch a power transfer mode automatically, ensuring improvement user convenience.

Further, the mode switching system 400 and the exercise bike 100 comprising the same, in one embodiment, provide a mode switching signal based on a press of the button 471 to the controller 500 or receive an instruction from a smart terminal to provide a mode switching signal to the controller, such that an instruction for a mode switch is given based on a press of the physical button 471 or a press of a software button.

Further, the mode switching system 400 and the exercise bike 100 comprising the same, in one embodiment, display a current power transfer mode state through the mode display 490, allowing the user to recognize the mode state readily with the naked eye.

Further, the mode switching system 400 and the exercise bike 100 comprising the same, in one embodiment, switch the non-freewheel mode and the freewheel mode automatically, ensuring improvement in user convenience.

Further, the mode switching system 400 and the exercise bike 100 comprising the same, in one embodiment, additionally provide functions in relation to the improvement in user convenience such as a function of preventing an accident and an operational error, a function of controlling an app link using a Bluetooth function, and the like, considering different use scenarios resulting from a mode switch.

Further, the mode switching system 400 and the exercise bike 100 comprising the same, in one embodiment, enables the user to switch a mode readily and to recognize a mode state, preventing the user from switching a mode unreasonably, and an accident caused by failure and an operational error of the device.

Furthermore, the mode switching system 400 and the exercise bike 100 comprising the same, in one embodiment, prevent an accident at a time of switching a mode, and provide an EMS brake function for a precise mode switch.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiments.

The invention claimed is:

1. A mode switching system, comprising;

a step motor fastening a face gear of an exercise bike to a wheel-face gear or separating the face gear from the wheel-face gear, based on a driving signal, to switch a power transfer mode to a non-freewheel mode or a freewheel mode;

a first limit sensor sensing a first part of the face gear and outputting a first sensing signal;

a second limit sensor sensing a second part of the face gear and outputting a second sensing signal; and a controller determining the power transfer mode of a current state by using the first sensing signal and the second sensing signal, and rotating the step motor forward or reverse, based on the power transfer mode of the current state, to switch the power transfer mode to the non-freewheel mode or the freewheel mode, in a case where a mode switching signal is input.

2. The mode switching system of claim 1, further comprising:

a first magnet being installed in a crank that connects to a pedal of the exercise bike; and a first Hall sensor being installed in a disc that connects to the crank, the first Hall sensor sensing a rotation of the first magnet and outputting a third sensing signal to the controller.

3. The mode switching system of claim 2, wherein the controller determines whether the crank rotates by using the third sensing signal, before a mode switch.

4. The mode switching system of claim 3, wherein the controller brakes the crank gradually and stops a rotation of the crank in a case where the controller confirms that the crank rotates.

5. The mode switching system of claim 1, further comprising;

a second magnet being installed in a flywheel of an electronic magnetic system of the exercise bike; and a second Hall sensor sensing a rotation of the second magnet and outputting a fourth sensing signal to the controller.

6. The mode switching system of claim 5, wherein the controller determines whether the flywheel rotates by using the fourth sensing signal, before a mode switch.

7. The mode switching system of claim 6, wherein the controller supplies a power source of a 100% duty ratio to the electronic magnetic system and stops a rotation of the flywheel in a case where the controller confirms that the flywheel rotates.

8. The mode switching system of claim 1, further comprising a switch outputting the mode switching signal that is based on a press of a button to the controller.

9. The mode switching system of claim 8, further comprising a mode display being disposed near the button and displaying the power transfer mode.

10. The mode switching system of claim 9, wherein the mode display comprises:

a first LED being turned on in the non-freewheel mode;

a second LED being turned off at a time of switching from the non-freewheel mode to the freewheel mode or switching from the freewheel mode to the non-freewheel mode; and a third LED being turned on in the freewheel mode.

11. The mode switching system of claim 1, wherein the controller checks the first sensing signal and the second sensing signal and recognizes whether a switch of the power transfer mode is completed during the switch of the power transfer mode.

12. The mode switching system of claim 11, wherein the controller stops the step motor, releases a brake applied to a crank, and supplies a power source of a 0% duty ratio to an electronic magnetic system, to rotate a flywheel, in a case where the controller recognizes the switch of the power transfer mode is completed.

13. The mode switching system of claim 1, further comprising a motor driver driving the step motor, wherein the controller provides a clock signal and a direction signal for controlling a rotation speed and a direction of the step motor to the motor driver.

14. The mode switching system of claim 1, further comprising a communicator communicating with an external smart terminal, wherein the communicator receives an instruction corresponding to the mode switching signal from the smart terminal, provides the instruction to the controller, and transmits a signal corresponding to a completion of a mode switch to the smart terminal.

15. An exercise bike, comprising:

a mode switching system that determines a power transfer mode of a current state and switches the power transfer mode of the current state to a non-freewheel mode or a freewheel mode, as a mode switching signal is input, the mode switching system, comprising:

a step motor fastening a face gear of an exercise bike to a wheel-face gear or separating the face gear from the wheel-face gear, based on a driving signal, to switch the power transfer mode of the current state to the non-freewheel mode or the freewheel mode;

a first limit sensor sensing a first part of the face gear and outputting a first sensing signal;

a second limit sensor sensing a second part of the face gear and outputting a second sensing signal; and a controller determining the power transfer mode of the current state by using the first sensing signal and the second sensing signal, and rotating the step motor forward or reverse, based on the power transfer mode of the current state, to switch the power transfer mode of the current state to the non-freewheel mode or the freewheel mode, in a case where the mode switching signal is input.

16. The exercise bike of claim 15, the mode switching system, further comprising:

a first magnet being installed in a crank that connects to a pedal of the exercise bike; and a first Hall sensor being installed in a disc that connects to the crank, the first Hall sensor sensing a rotation of the first magnet and outputting a third sensing signal to the controller.

17. The exercise bike of claim 16, wherein the controller determines whether the crank rotates by using the third sensing signal, before a mode switch, and brakes the crank gradually and stops a rotation of the crank in a case where the controller confirms that the crank rotates.

18. The exercise bike of claim 15, further comprising:

a second magnet being installed in a flywheel of an electronic magnetic system of the exercise bike; and a second Hall sensor sensing a rotation of the second magnet and outputting a fourth sensing signal to the controller.

19. The exercise bike of claim 18, wherein the controller determines whether the flywheel rotates by using the fourth sensing signal, before a mode switch, supplies a power source of a 100% duty ratio to the electronic magnetic system and stops a rotation of the flywheel in a case where the controller confirms that the flywheel rotates.

20. The exercise bike of claim 15, wherein the controller checks the first sensing signal and the second sensing signal and recognizes whether a switch of the power transfer mode is completed, during the switch of the power transfer mode, and the controller stops the step motor, releases a brake applied to the crank, and takes an electromagnetic force out of an electronic magnetic system, in a case where the switch of the power transfer mode is completed.

* * * * *